United States Patent [19]

Hsu

[11] Patent Number: 4,527,786

[45] Date of Patent: Jul. 9, 1985

[54] WORKBENCH

[76] Inventor: Wen C. Hsu, No. 12, Road 18, Industrial District, Taichung, Taiwan

[21] Appl. No.: 452,209

[22] Filed: Dec. 22, 1982

[30] Foreign Application Priority Data

Jul. 30, 1982 [TW] Taiwan ..... 7124242

[51] Int. Cl.[3] ..... B25B 1/00

[52] U.S. Cl. ..... 269/154; 269/16; 269/155; 269/164; 269/244; 269/901; 269/902; 269/283

[58] Field of Search ..... 269/16, 152, 154, 155, 269/244, 258, 283, 901, 902, 269, 164

[56] References Cited

U.S. PATENT DOCUMENTS 2,322,380 6/1943 Mosley ..... 269/152
2,881,645 4/1959 Kruchten ..... 269/258
4,155,386 5/1979 Alessio ..... 144/286 R X
4,248,411 2/1981 Wagster et al. ..... 269/244

*Primary Examiner*—Frederick R. Schmidt
*Assistant Examiner*—Judy J. Hartman

[57] ABSTRACT

A workbench having a pair of vise assemblies mounted on a frame with each vise assembly having a movable jaw and a fixed jaw, wherein one vise assembly is operable with a lead screw to move towards and away from the other vise assembly which is fixed and arranged parallel to the movable vise assembly. Each movable jaw is operable with a screw threaded rod to move towards and away from each corresponding fixed jaw, and is capable of swivelling so as to enable the clamping of an irregularly shaped workpiece between the fixed and movable jaws. The pair of vise assemblies with their frame are mounted on a collapsible supporting structure which may be folded when not in use.

4 Claims, 9 Drawing Figures

WORKBENCH

BACKGROUND OF THE INVENTION

Conventional workbenches generally comprise a table provided with a vise for holding a workpiece. The vise generally has a pair of jaws having two parallel surfaces opposed to each other and is normally suitable for clamping therebetween a workpiece having a regular shape, such as rectangular or square shape. However, for a workpiece having an irregular shape, such conventional workbenches cannot be used satisfactorily. For an elongated, tapered workpiece a number of workbenches have been offered such as those disclosed in U.S. Pat. Nos. 3,841,619; 4,034,684; 4,127,260; 4,140,309; 4,154,435; 4,155,386; 4,157,174; 4,159,821 and 4,169,606; however, the workbences disclosed in these patents are only good for clamping an elongated, tapered workpiece. These workbenches are minimally useful for clamping an irregularly shaped workpiece such as a toy hand tool, picture frame, sports equipment and the like.

In view of the aforesaid problems with conventional workbenches, the present invention offers a novel workbench having a pair of vise assemblies mounted on a frame, wherein each vise assembly is provided with a movable jaw capable of swivelling and also moving towards and away from a fixed jaw, to facilitate clamping of an irregularly shaped workpiece. One of the pair of vise assemblies is fixedly mounted on the frame while the other is slidably mounted and arranged parallel to the fixed vise assembly. An operating device is provided to the movable vise assembly for moving the movable vise assembly towards and away from the fixed vise assembly in a direction generally perpendicular to the direction of the movement of the movable jaw, so as to give a wide range of adaptability as to the size and shape of the workpiece to be clamped therein.

The present invention further offers a workbench having aforesaid vise assemblies with their frame and a collapsible supporting structure on which the vise assemblies with their frame are mounted, wherein the supporting structure can be conveniently folded and expanded as desired, to facilitate easy storage when not in use.

Therefore, it is the main object of this invention to provide a workbench having a pair of vise assemblies mounted on a frame, for clamping regularly shaped and irregularly shaped articles.

It is another object of this invention to provide a workbench having a pair of vise assemblies mounted on a frame with each vise assembly having a movable jaw and a fixed jaw, wherein one vise assembly is movable towards and away from the other vise assembly which is fixed and arranged parallel to the movable vise assembly to provide a wide range of adaptability as to the size and shape of the article to be clamped therein.

It is still another object of this invention to provide a workbench that can be folded when not in use.

BRIEF OF DESCRIPTION OF THE DRAWINGS

DETAILED DESCRIPTION OF THE INVENTION

Figure 1:
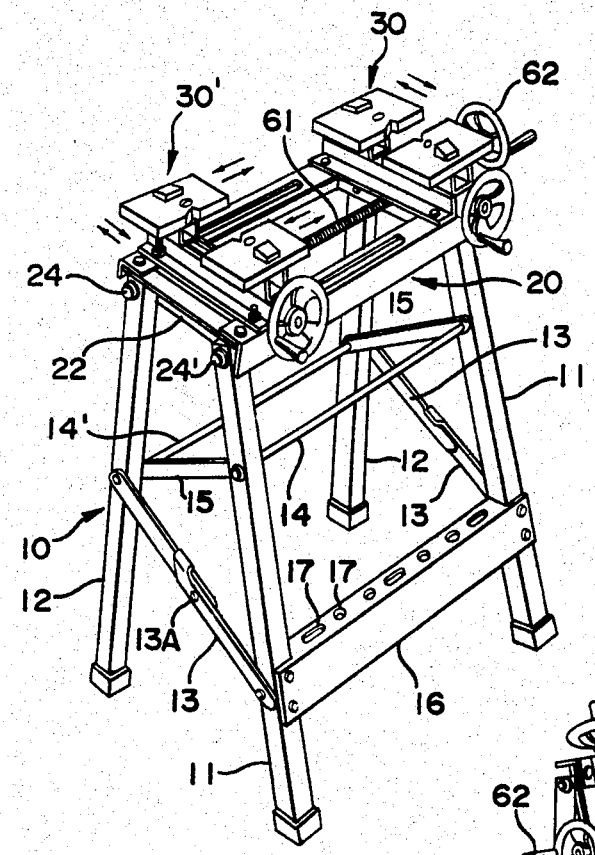
FIG. 1 is an oblique, perspective view of the workbench of this invention, being readily erected for use.

As shown in FIG. 1, the workbench of this invention comprises s collapsible, supporting structure 10, a frame 20 pivotally supported on top of supporting structure 10, and a pair of vise assemblies consisting of fixed vise assembly 30 fixedly mounted on frame 20 and movable vise assembly 30' movably mounted on frame 20.

As shown in FIG. 1, supporting structure 10 comprises a pair of front legs 11, a pair of rear legs 12, a pair of connecting bars 13 having two ends respectively pivotally connected to one front leg 11 and one corresponding rear leg 12, each connecting bar 13 having a pivotal joint 13A at its midportion so that connecting bar 13 can be folded to pull front leg 11 and rear leg 12 together. Supporting structure 10 is further reinforced by a tie rod 14 to connect the pair of front legs 11, another tie rod 14' to connect the pair of rear legs 12, and two link members 15 each pivotably connected between one front leg 11 and one corresponding rear leg 12. An angle member 16 is fixedly provided across the lower span of the front legs 11, angle member 16 having a plurality of holes 17 for allowing the insertion of hand tools such as screw drivers and claw members to be described later as a temporary storage shelf.

Figure 3:
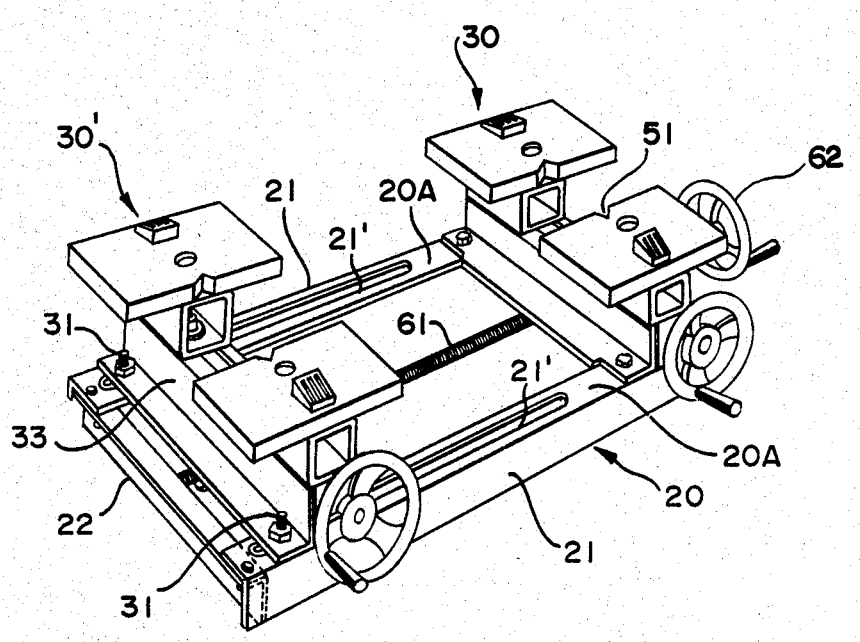
FIG. 3 is an oblique, perspective view of the pair of vise assemblies of the workbench of this invention, having the supporting structure removed.

Referring to FIG. 1, and also FIG. 3, frame 20 is constructed from a pair of first angle members 21 having an upper planar surface 20A and an elongated slot 21', and being arranged parallel to each other, and a pair of second angle members 22 fixedly connected to the end portions of first angle members 21 so as to form a substantially rectangular frame.

The two opposite ends of each second angle member 22 are respectively and pivotally connected to the upper ends of front legs 11 and rear legs with pivot pins 24.

Figure 2:
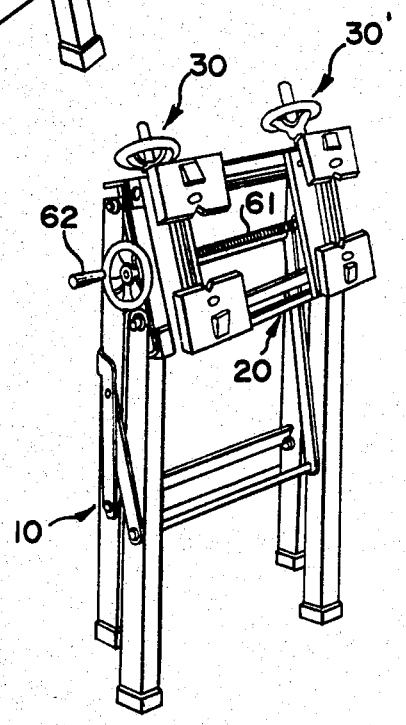
FIG. 2 is an oblique, perspective view of the workbench of this invention, being folded for storage.

With the arrangement as described above, the supporting structure 10 can be folded by first folding connecting bars 13 so as to pull the lower ends of front legs 11 and rear legs 12 towards each other, then moving the pair of front legs 11 upwardly to tilt frame 20 as shown in FIG. 2, so as to cause front legs 11 and rear legs 12 to substantially abut each other in paralled,for easy storage when the workbench is not in use.

As shown in FIG. 3, frame 20 is provided with fixed vise assembly 30 which is fixedly mounted on frame 20 and substantially above and along one of the second angle members, and movable vise assembly 30′ which is movably mounted on frame 20 and substantially parallel to fixed vise assembly 30. The construction of movable vise assembly 30′ as shown in FIG. 4, is identical to that of fixed vise assembly 30, except that movable vise assembly 30′ is mounted on first angle members 21 by bolts 31 (FIG. 3) passing through slot 21′ formed in each first angle member 21 and capable of moving along upper planar surface 20A towards and away from fixed vise assembly 30 by operating lead screw 61 to be described later.

Figure 4:
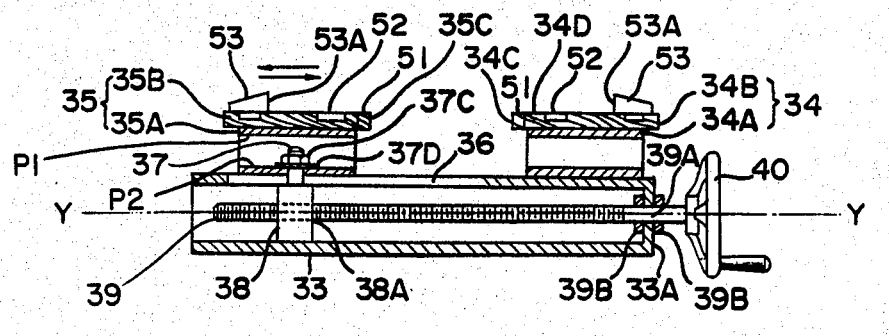
FIG. 4 is a longitudinal cross sectional view of one vise assembly of the workbench of this invention.

As shown in FIG. 4, the vise assembly, either movable or fixed, comprises a base 33 composed of an elongated member having a longitudinal axis Y—Y and an upper surface provided with an elongated slot 36, a fixed jaw 34 fixedly mounted on the opposite end of base 33. Fixed jaw 34 comprises a carrier 34A of generally a box-shaped construction securely fixed on to base 33 and a clamping plate 34B of generally rectangular shape securely fixed on top of carrier 34A, clamping plate 34B having an upper surface 34D generally parallel to the upper planar surface 20A of frame 20 on which base 33 is mounted, and a clamping surface 34C generally perpendicular to upper surface 34D and longitudinal axis Y—Y of base 33, said clamping surface 34C being disposed to face movable jaw 35. In the midportion of clamping surface 34C there is provided a notch 51 (FIG. 3). Movable jaw 35 comprises a carrier 35A of generally a box-shaped construction having an upper plate P1 and lower plate P2, and is mounted on base 33 with bolt 37 which extends through lower plate P2 and is fastened thereto with nut 37C. Movable jaw 35 is capable of sliding along the upper surface of base 33 and swivelling around bolt 37. On top of upper plate P1 of carrier 35A is securely fixed a clamping plate 35B which is identical to clamping plate 34B of fixed jaw 34 with respect to size and shape, and has an upper surface 35D coplanar with upper surface 34D of clamping plate 34A of fixed jaw 34, and clamping surface 35C perpendicular to upper surface 35D.

Figure 5:
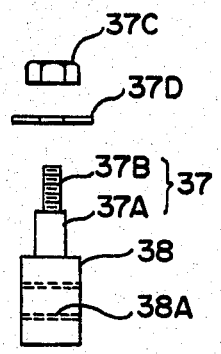
FIG. 5 is an enlarged, exploded view of the swivel joint of the movable jaw shown in FIG. 4.

Within base 33, as shown in FIG. 4, there is a slide block 38 capable of sliding therein along longitudinal axis Y—Y of base 33, slide block 38 having a screw-threaded hole 38A to engage screw-threaded rod 39 having one end provided with a crank handle 40 and a neck portion 39A rotatably supported by an end member 33A of base 33. Screw-threaded rod 39 is further provided with stopper members 39B so as to prevent screw-threaded rod 39 from axial movement. Bolt 37 as shown in FIG. 5, is integrally formed with slide block 38 and is provided with a stem portion 37A of a suitable length and a suitable diameter to extend upwardly perpendicularly through elongated slot 36 of base 33, and a threaded portion 37B having a diameter smaller than that of stem portion 37A. Carrier 35A of movable jaw 35 is mounted on base 33 with bolt 37, washer 37D and nut 37C in such a manner that the upper end of stem portion 37A extends slightly above the lower plate P2 (FIG. 4) so that nut may be tightened to force washer 37D against the end face of stem portion 37A without exerting a pressure on lower plate P2 of carrier 35, so as to enable movalbe jaw 35 to slide along the upper surface of base 33 when crank handle 40 is rotated to cause slide block 38 to move along lingitudinal axis Y—Y of base 33, and also to enable carrier 35A to swivel freely around bolt 37.

Each clamping plate (34B, 35B) is further provided with holes 52 and a claw member 53 adapted to fit holes 52 selectively and detachably, claw member 53 having a retaining face 53A perpendicular to the upper surface (34D, 35D) of clamping plate (34B, 35B).

With the construction and arrangement of fixed jaw 34 and movable jaw 35 as described above, movable jaw 35 can be moved towards and away from fixed jaw 34 by rotating crank handle 40, to clamp a workpiece in between the two clamping surfaces 34C and 35C, or to release a workpiece therefrom. The workpiece may also be placed on clamping plates 34B and 35B and clamped between two claw members 53.

Figure 6:
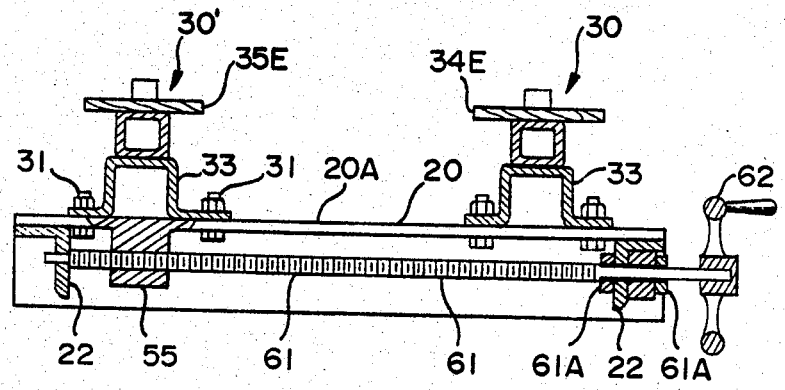
FIG. 6 is a transversal cross sectional view of the vise assemblies, showing the arrangement of the lead screw adapted to move the movable vise assembly towards and away from the fixed vise assembly.

Referring to FIG. 6, underneath base 33 of movable vise assembly 30′ there is provided a nut member 55 securely attached or welded to base 33, to engage with a lead screw 61 having one end provided with crank handle 62, lead screw 61 being rotatably supported by second angle members 22 of frame 20. Two thrust collars 61A are fixedly provided on lead scew 61 at both sides of a second angle member 22 to prevent axial movement of lead screw 61.

As shown in FIGS. 3 and 5, movable vise assembly 30′ is detachably mounted onto frame 20 with bolts 31 passing through elongated slots 21′ formed on first angle members 21. By loosening bolts 31 and rotating hand crank 62 to cause lead screw 61 to rotate, movable vise assembly 30′ can be moved towards and away from fixed vise assembly 30, so as to adjust the position of movable vise assembly 30′ in relation to fixed vise assembly 30. As soon as the position of movable vise assembly 30′ is determined, bolts 31 may be tightened to fix movable vise assembly 30 in place. Movable vise assembly 30 can be removed by first removing bolts 31, when not required.

With bolts 31 suitably loosened, movable vise assembly 30′ can also be moved towards and away from fixed vise assembly 30 by rotating crank handle 62 to rotate lead screw 61, and the pair of vise assemblies 30, 30′ can be conveniently used to clamp a workpiece between the side surfaces 34E, 35E of clamping plates 34B and 35B of fixed and movable vise assemblies.

Figure 7:
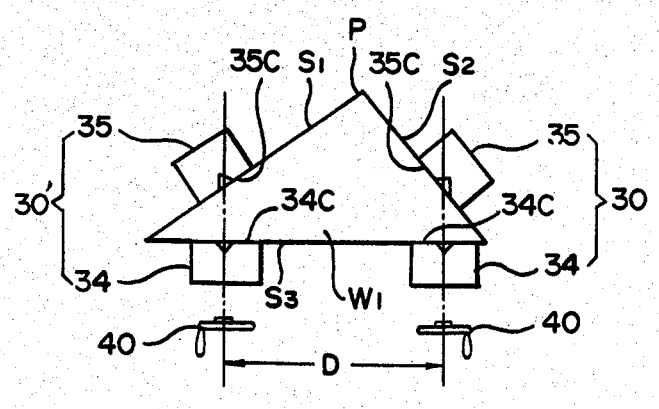
FIG. 7 is a schematic drawing showing an example of the clamping of a triangular workpiece between the pair of vise assemblies with the workbench of this invention.

FIG. 7 shows an example of the application of the workbench of this invention, wherein a workpiece W1 of triangular shape is clamped. To clamp workpiece W1, movable vise assembly 30′ is first moved and fixed in place having a distance D from fixed vise assembly 30, so that one may work on the peak portion P of workpiece W1. Then each vise assembly is operated to move each movable jaw 35 away from respective fixed jaw 34 to provide an adequate space for placing workpiece W1 between movable and fixed jaws 35 and 34. Thirdly crank handle 40 of each vise assembly is operated to move each movable jaw 35 towards respective fixed jaw 34 with each movable jaw 35 rotated in such way that clamping surface 35C of each movable jaw 35 is aligned generally parallel with inclined surface S1 and S2 of workpiece W1 respectively while workpiece W1 is held by hand with its third surface S3 abutting clamping surface 34C of each fixed jaw 34. As soon as clamping surfaces 35C of movable jaws 35 come into contact with the inclined surfaces S1 and S2 respectively, crank handles 40 are further rotated to apply a pressure on movable jaws 35 towards fixed jaws 34. Movable jaws 35 will seat on respective inclined surface S1 and S2 properly even if clamping surfaces 35C were not aligned accurately initially with respective to the inclined surfaces S1 and S2 of workpiece W1.

In case the workpiece does not have a flat surface to abut clamping surface 34C or 35C or is of irregular shape, one may advantageously select an edge, or a corner, or a projection on the workpiece to fit notch 51 in each clamping surface 34C, 35C and the workpiece can be clamped in the same manner as described above.

Figure 8:
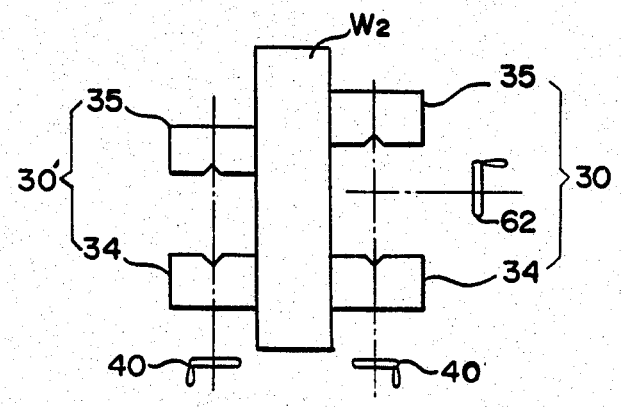
FIG. 8 is a schematic drawing showing an example of the clamping of a rectangular workpiece between the pair of vise assemblies with the workbench of this invention.

FIG. 8 shows an example wherein workpiece W2 is clamped between movable vise assembly 30′ and fixed vise assembly 30, by operating crank handle 62 to cause movable vise assembly 30′ to move towards fixed vise assembly 30. In this case the position of each movable jaw 35, 35′ with respect to the respective fixed jaw 34, 34′ can be selectively pre-determined by operating respective crank handle 40.

Figure 9:
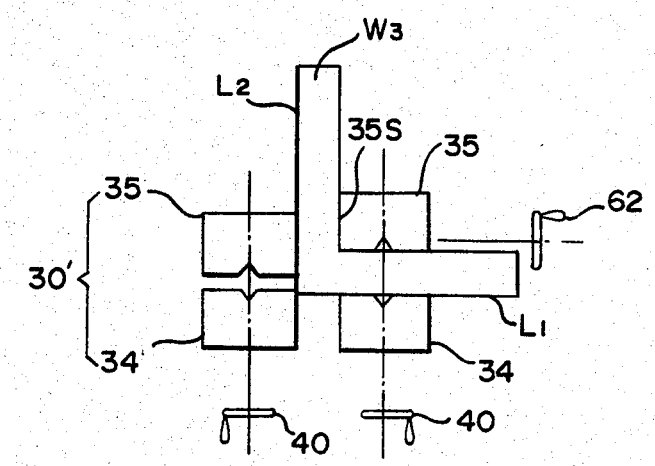
FIG. 9 is a schematic drawing showing an example of the clamping of an L-shaped workpiece between the pair of vise assemblies with the workbench of this invention.

FIG. 9 shows an example wherein workpiece W3 of L-shape having first leg L1 and second leg L2 perpendicular to first leg L1 is clamped between fixed vise assembly 30 and movable vise assembly 30′. First leg L1 is first clamped between fixed and movable jaws 34, 35 of fixed vise assembly 30 with second leg L2 abuting the side face 35S of movable jaw 35 of fixed vise assembly 30, and then movable vise assembly 30′ is moved by cranking crank handle 62 towards fixed vise assembly to clamp second leg L2 between fixed vise assembly 30 and movable vise assembly 30′.

It is to be understood, without description in further detail, that either vise assembly can be used independently as a separate unit for clamping a relatively small workpiece.

What is claimed is:

1. A work bench, comprising:

a supporting structure;

a rectangular frame comprising a first pair of parallel angle members each having an upper planar surface and an elongated slot therein and a second pair of parallel angle members fixedly connected to end portions of each of said first pair of angle members, said rectangular frame being pivotally supported on top of said supporting structure;

a first vise assembly fixedly mounted on said rectangular frame and substantially above and along one of said second pair of angle members;

a second vise assembly slidably and detachably mounted on said rectangular frame and being arranged in parallel to said first vise assembly, and being operable with a first leadscrew having a crank handle for selectively moving said second vise assembly over and along said first pair of angle members towards and away from said first vise assembly;

said first and second vise assemblies each comprising a fixed jaw, a movable jaw to correspond with said fixed jaw, and an elongated base on which said fixed jaw is fixedly mounted and said movable jaw is slidably mounted; said movable jaw being operable with a second screw-threaded rod having a crank handle for moving said movable jaw towards and away from said fixed jaw along the longitudinal axis of said elongated base;

each of said movable jaw also being capable of swivelling around a bolt with which each of said movable jaw is slidably mounted on said elongated base, said bolt having one end integrally formed into a block provided with a screw threaded hole to mesh with said screw-threaded rod; and the elongated base of said second vise assembly being slidably and detachably mounted on said first pair of angle members with bolts passing through said elongated slots in said first pair of angle members, said bolts being adaped to selectively allow said elongated base of said second vise assembly to slide along said first pair of angle members or to fasten said elongated base of said second vise assembly on said first pair of angle members.

2. A workbench as recited in claim 1, wherein:

each of said fixed jaw is provided with a rectangular, first plate member having a flat upper surface parallel to said upper planar surface of said frame, and a first clamping surface perpendicular to said upper surface, said clamping surface facing each of said movable jaw and having a notch therein, and each of said movable jaw is provided with a rectangular second plate member having a flat upper surface coplanar with the upper surface of said first plate member, and a second clamping surface perpendicular to said second upper surface, said second clamping surface having a notch therein.

3. A workbench as recited in claim 2, wherein each of said first and second plate members are each provided with a hole in the upper surface thereof, and a claw member adapted to be selectively retained by said hole, said claw member having a face perpendicular to said upper surface of each of said first and second plate members.

4. A workbench as recited in claim 1 wherein said supporting structure is provided with a pair of front legs and a pair of rear legs each pair of front and rear legs being respectively provided with a tie rod for fixedly tying respective legs, and the pair of front legs being pivotally connected to the pair of rear legs with a collapsible bar which can be folded to fold said supporting structure with said frame tilted and the pairs of front legs and rear legs abutting each other in parallel.

* * * * *